US011761243B2

(12) United States Patent
Lien

(10) Patent No.: US 11,761,243 B2
(45) Date of Patent: Sep. 19, 2023

(54) CLUTCH MECHANISM AND ELECTRONIC LOCK HAVING THE SAME

(71) Applicant: Waferlock Corp., Taichung (TW)

(72) Inventor: Chih-Min Lien, Taichung (TW)

(73) Assignee: Waferlock Corp., Taichung (TW)

( * ) Notice: Subject to any disclaimer, the term of this patent is extended or adjusted under 35 U.S.C. 154(b) by 223 days.

(21) Appl. No.: 17/350,189

(22) Filed: Jun. 17, 2021

(65) Prior Publication Data

US 2022/0268059 A1 Aug. 25, 2022

(30) Foreign Application Priority Data

Feb. 23, 2021 (TW) ..... 110106320

(51) Int. Cl.
*E05B 47/06* (2006.01)
*E05B 47/00* (2006.01)

(52) U.S. Cl.
CPC ..... *E05B 47/068* (2013.01); *E05B 47/0001* (2013.01); *E05B 47/0012* (2013.01); *E05B 47/0615* (2013.01); *E05B 2047/0023* (2013.01); *E05B 2047/0026* (2013.01); *E05B 2047/0058* (2013.01)

(58) Field of Classification Search
CPC ..... E05B 2047/0026; E05B 2047/0028; E05B 2047/003; E05B 2047/0031; E05B 17/0054; E05B 17/0058; E05B 17/044; E05B 17/045; E05B 17/046; E05B 47/0615; E05B 47/0676; E05B 47/068; E05B 47/0012; E05B 2047/0058
See application file for complete search history.

(56) References Cited

U.S. PATENT DOCUMENTS 5,150,592 A * 9/1992 Lin ..... E05B 13/101 70/381

FOREIGN PATENT DOCUMENTS

CN 103711368 A * 4/2014

OTHER PUBLICATIONS

Machine translation of CN 103711368 A (Year: 2014).*

* cited by examiner

*Primary Examiner* — Christine M Mills
*Assistant Examiner* — Peter H Watson
(74) *Attorney, Agent, or Firm* — BLANK ROME LLP

(57) ABSTRACT

An electronic lock includes a latch member and a clutch mechanism mounted on the outside of the lock cylinder and including a clutch unit, a driving unit and a control module. The clutch unit includes a rotatable seat having a first engaging portion, an accessible knob, and a clutch seat having a second engaging portion. The clutch seat is movable relative to the rotatable seat between an unlock position and a lock position, where the second engaging portion engages and disengages the first engaging portion, respectively.

24 Claims, 17 Drawing Sheets

CLUTCH MECHANISM AND ELECTRONIC LOCK HAVING THE SAME

CROSS-REFERENCE TO RELATED APPLICATION

This application claims priority to Taiwanese Patent Application No. 110106320 filed on Feb. 23, 2021.

FIELD

The disclosure relates to a latch, more particularly to an clutch mechanism of an electronic lock and an electronic lock having the same.

BACKGROUND

Referring to FIGS. 1 and 2, a conventional electronic lock 1 disclosed in Chinese Patent No. CN 103670037 includes an inner knob 11, an outer knob 12, a lock cylinder 13, a lock core unit 14, two clutch units 15, a sensing unit 16, and a driving motor 17. The lock cylinder 13 is disposed between the inner knob 11 and the outer knob 12, and is formed with a through hole 131 extending along an in-out direction (D). The lock core unit 14 is mounted to the lock cylinder 13 and includes a lock cylinder shaft 141 extending movably through the through hole 131 of the lock cylinder 13 along the in-out direction (D), a bush 142 sleeved rotatably on the lock cylinder shaft 141, and a pushing block 143 sleeved on the bush 142 and driven by the bush 142 to rotate so as to lock and unlock the electronic lock. The bush 142 is formed with two recesses 144 extending along the in-out direction (D) and disposed respectively adjacent to the inner knob 11 and the outer knob 12. The clutch units 15 are disposed in the through hole 131 of the lock cylinder 13, are connected respectively to opposite ends of the lock cylinder shaft 141, are connected respectively to the inner and outer knobs 11, 12, and engage respectively the recesses 144 of the bush 142. Each of the clutch units 15 includes a slidable block 151 fixed to and movable with the lock cylinder shaft 141 along the in-out direction (D), and a spring 152 for driving the slide block 151 to move. The sensing unit 16 includes an inner sensor 161 and an outer sensor 162 disposed respectively on the inner and outer knobs 11, 12. The driving motor 17 is disposed in the inner knob 11 and is connected to the spring 152 of one of the clutch units 15. When the outer sensor 162 detects the presence of a sensing card (not shown), a spindle 171 of the driving motor 17 is driven to rotate and the spring 152 of the one of the clutch units 15 is driven to push a corresponding one of the slidable block 151, which drives the lock cylinder shaft 141 to move outwardly so as to engage the corresponding one of the recesses 144. Thus, the outer knob 12 can be operated to lock or unlock the electronic lock.

However, the clutch units 15 are mounted in the lock cylinder 13, which is inconvenient to install and replace.

SUMMARY

Therefore, an object of the disclosure is to provide a clutch mechanism of an electronic lock and an electronic lock having the same capable of alleviating the drawbacks of the conventional electronic lock.

According to an aspect of the disclosure, a clutch mechanism of an electronic lock is provided. The clutch mechanism is adapted to be mounted on a lock cylinder. The lock cylinder includes a latch member extending along an axis that extends along an in-out direction and operable to rotate about the axis to lock and unlock the electronic lock. The clutch mechanism includes a clutch unit, a driving unit and a control module. The clutch unit includes a rotatable seat, an accessible knob and a clutch seat. The rotatable seat is adapted to be rotatably sleeved on the lock cylinder and permits the latch member to extend therethrough. The accessible knob is adapted to be rotatably sleeved on the lock cylinder and engages an end portion of the rotatable seat so as to drive the rotatable seat to rotate about the axis. The clutch seat detachably engages an opposite end portion of the rotatable seat and is adapted to be movable relative to the latch member along the in-out direction. The rotatable seat includes a bush section and a connecting section. The bush section is adapted to be sleeved on the lock cylinder. The connecting section extends from the bush section away from the clutch seat along the in-out direction, and has a first engaging portion adjacent to the clutch seat, and a first coupling portion adjacent to the accessible knob. The accessible knob includes an annular portion adapted to be sleeved on the lock cylinder, and a second coupling portion non-rotatably coupled to the first coupling portion of the rotatable seat. The clutch seat includes a sleeve ring portion sleeved on the bush section of the rotatable seat, and a second engaging portion detachably engaging the first engaging portion. The clutch seat is movable relative to the rotatable seat between an unlock position and a lock position, where the second end engaging portion engages and disengages the first engaging portion, respectively. The driving unit includes a pivot pin, a biasing member and a driving device. The biasing member includes a main body, a first arm and a second arm. The pivot pin extends through the main body. The first arm extends from the main body along an up-down direction transverse to the in-out direction and engages the clutch seat. The second arm extends from the main body along the in-out direction and is connected to the driving device. The driving device is operable to drive the biasing member to move the clutch seat between the unlock position and the lock position. The control module is communicatively connected to the driving unit and is configured to control operation of the driving unit to drive the biasing member to move the clutch seat between the unlock position and the lock position.

According to another aspect of the disclosure, an electronic lock is provided to include a lock device and a clutch mechanism. The lock device includes a lock cylinder that includes a latch member extending along an axis that extends along an in-out direction and operable to lock and unlock the lock device. The clutch mechanism is mounted to the lock cylinder and includes a clutch unit, a driving unit and a control module. The clutch unit includes a rotatable seat, an accessible knob, and a clutch seat. The rotatable seat is rotatably sleeved on the lock cylinder and permits the latch member to extend therethrough. The accessible knob is rotatably sleeved on the lock cylinder and engages an end portion of the rotatable seat so as to drive the rotatable seat to rotate about the axis. The clutch seat detachably engages an opposite end portion of the rotatable seat and is movable relative to the latch member along the in-out direction. The rotatable seat includes a bush section and a connecting section. The bush section is sleeved on the lock cylinder. The connecting section extends from the bush section away from the clutch seat along the in-out direction, and has a first engaging portion adjacent to the clutch seat, and a first coupling portion adjacent to the accessible knob. The accessible knob includes an annular portion that is sleeved on the lock cylinder, and a second coupling portion that is non-rotatably coupled to the first coupling portion of the rotatable seat. The clutch seat includes a sleeve ring portion that is sleeved on the bush section of the rotatable seat, and a second engaging portion that detachably engages the first engaging portion. The clutch seat is movable relative to the rotatable seat between an unlock position and a lock position, where the second engaging portion engages and disengages the first engaging portion, respectively. The driving unit includes a pivot pin, a biasing member and a driving device. The biasing member includes a main body, a first arm and a second arm. The pivot pin extends through the main body. The first arm extends from the main body along an up-down direction transverse to the in-out direction and engages the clutch seat. The second arm extends from the main body along the in-out direction and is connected to the driving device. The driving device is operable to drive the biasing member to move the clutch seat between the unlock position and the lock position. The control module is communicatively connected to the driving unit and is configured to control operation of the driving unit to drive the biasing member to move the clutch seat between the unlock position and the lock position.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
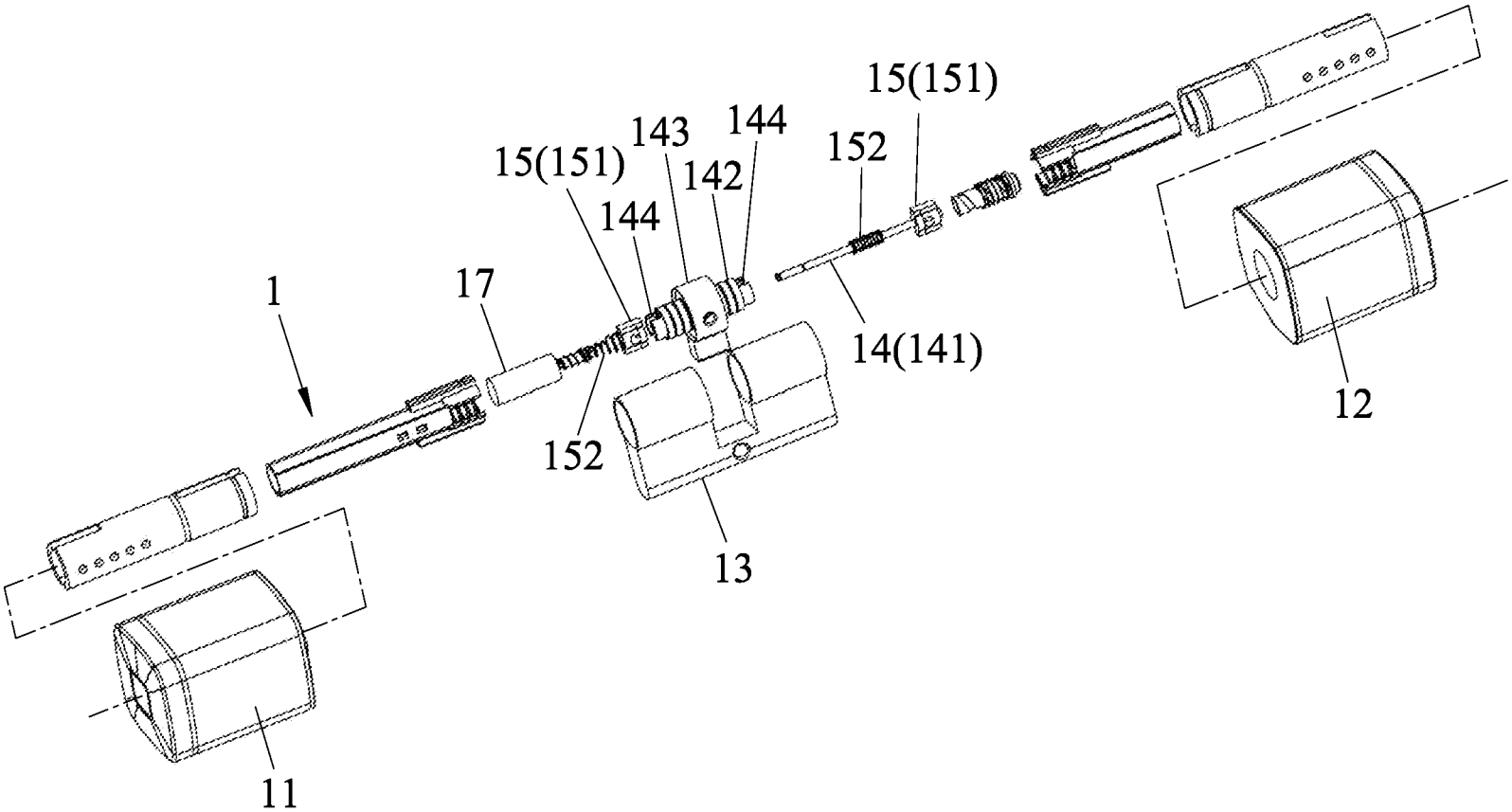
FIG.1 PRIOR ART
FIG. 1 is an exploded perspective view of a conventional electronic lock disclosed in Chinese Patent No. 103670037.
Figure 2:
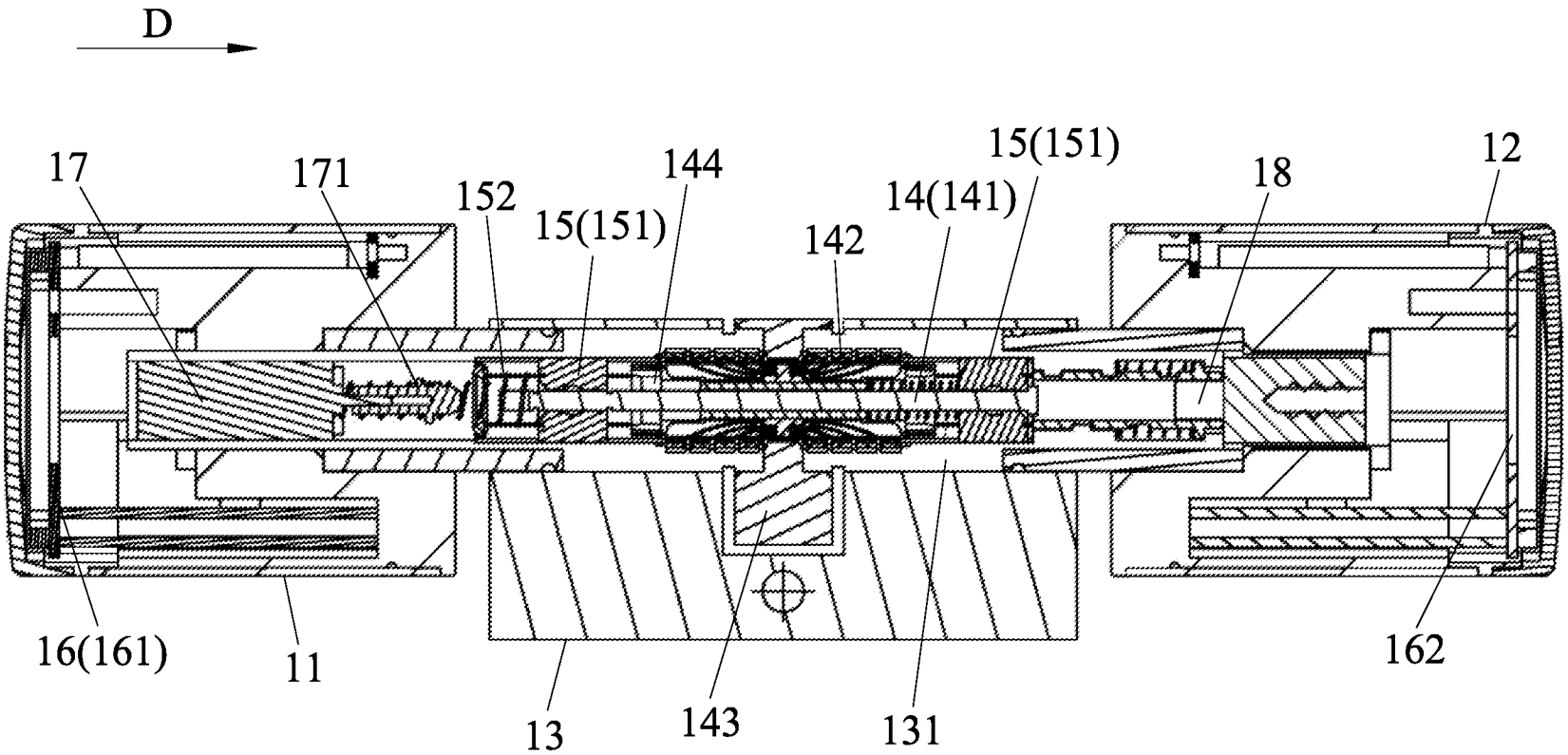
FIG.2 PRIOR ART
FIG. 2 is a schematic sectional view of the conventional electronic lock shown in FIG. 1.

Before the present disclosure is described in greater detail, it should be noted herein that like elements are denoted by the same reference numerals throughout the disclosure.

To aid in describing the disclosure, directional terms may be used in the specification and claims to describe portions of the present disclosure (e.g., front, rear, left, right, top, bottom, etc.). These directional definitions are intended to merely assist in describing and claiming the disclosure and are not intended to limit the disclosure in any way.

Figure 3:
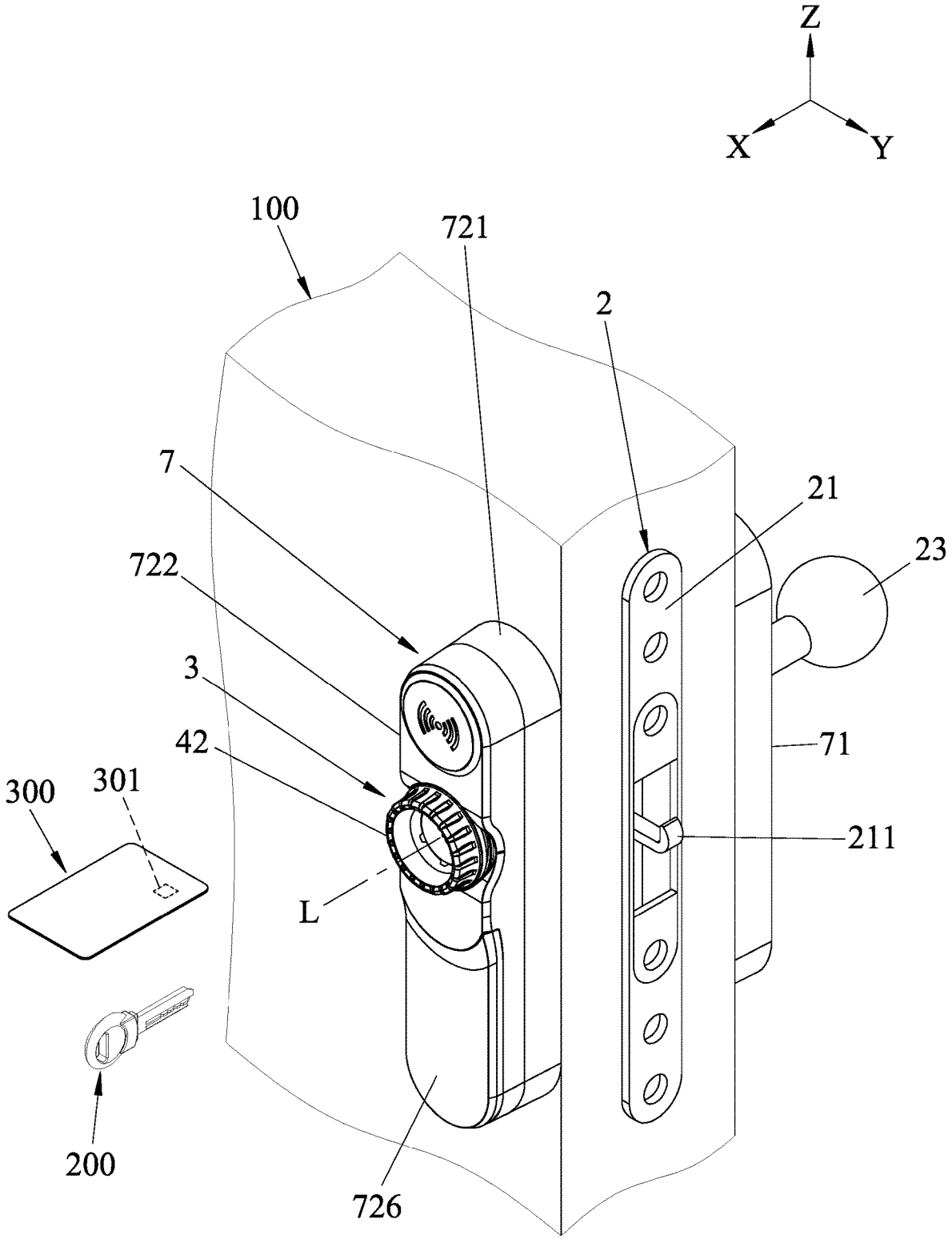
FIG. 3 is a fragmentary schematic perspective view illustrating a first embodiment of the electronic lock according to the present disclosure being mounted on a door.
Figure 4:
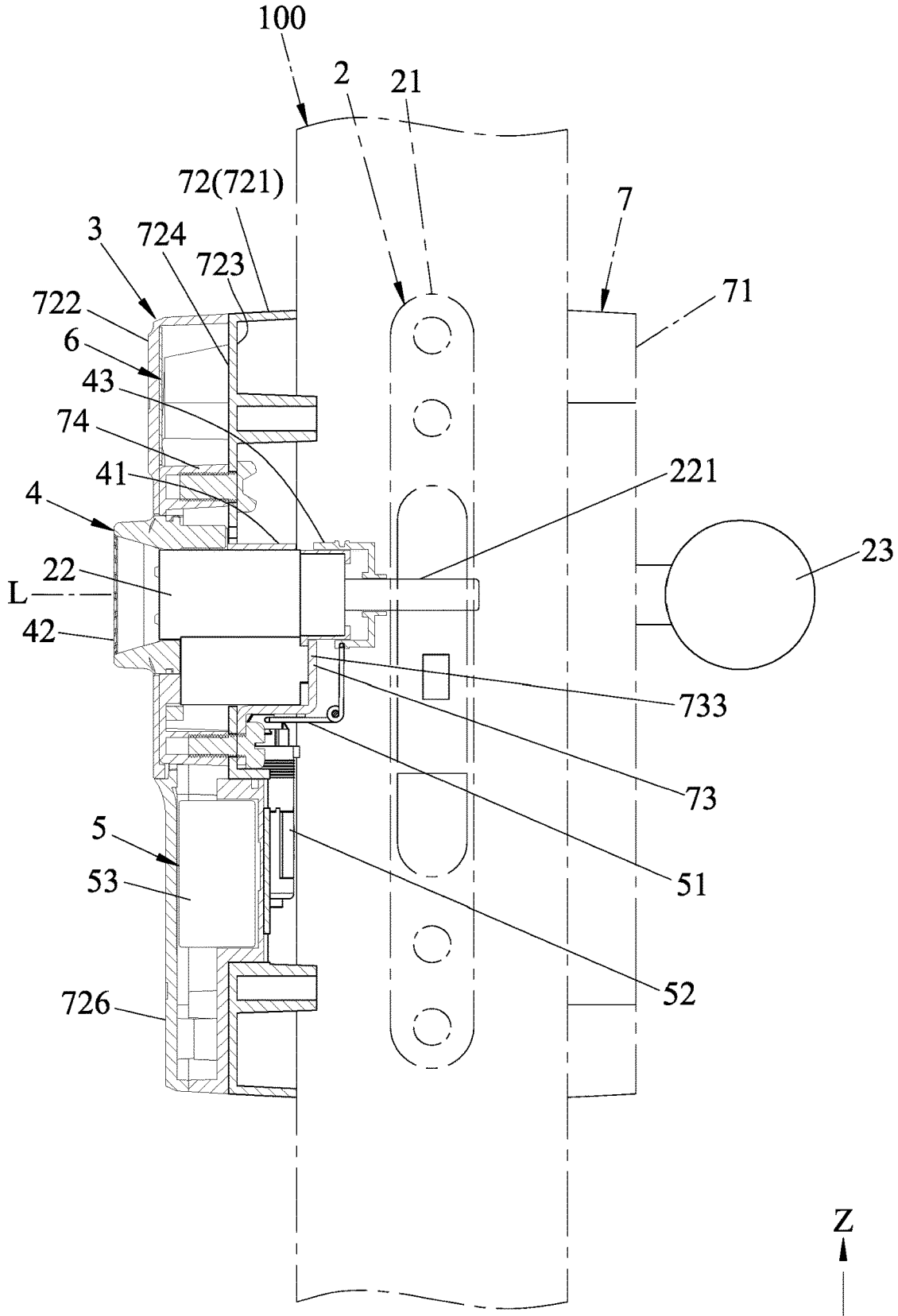
FIG. 4 is a fragmentary schematic sectional view of FIG. 3.
Figure 5:
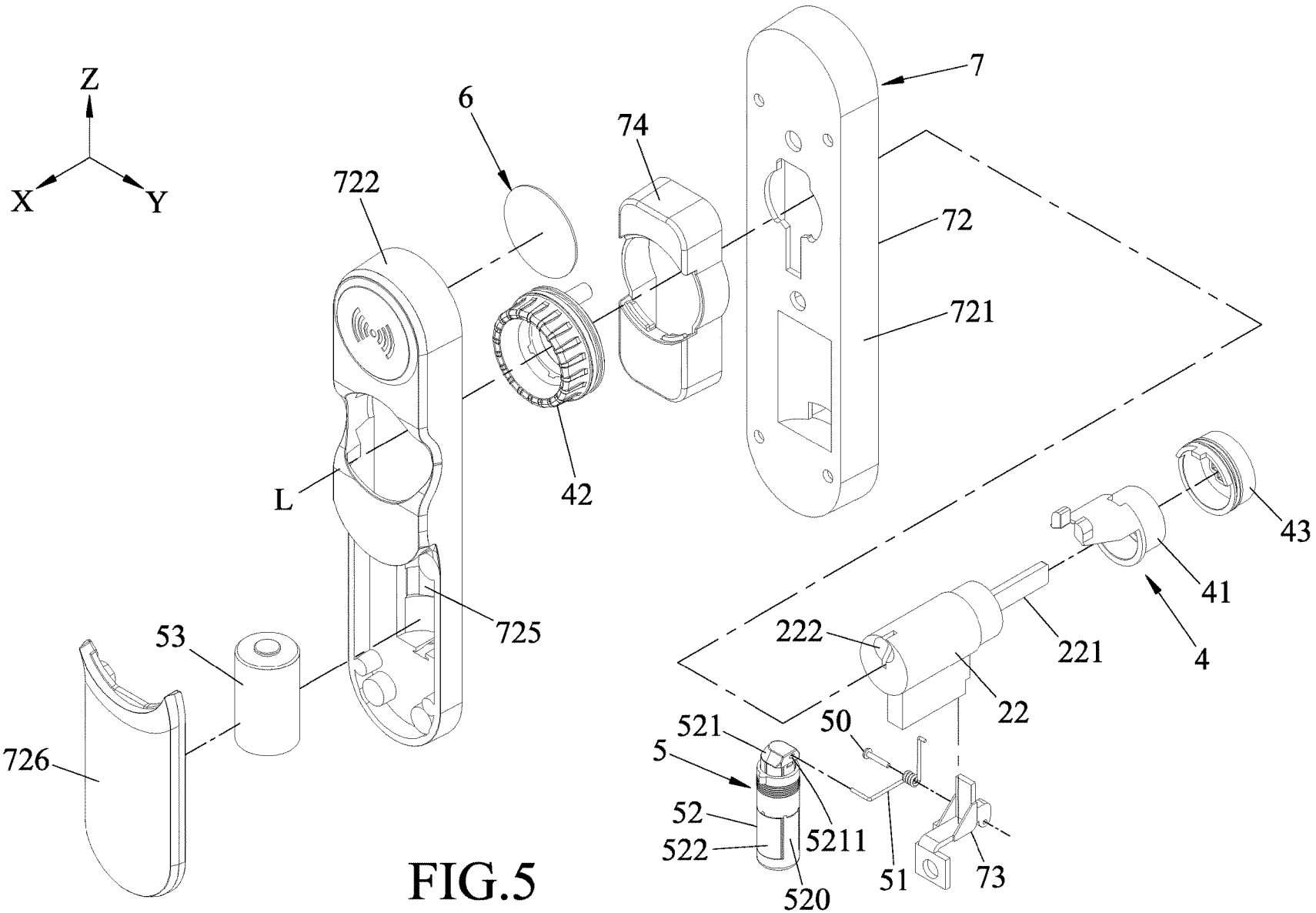
FIG. 5 is an exploded perspective view of the first embodiment.

Referring to FIGS. 3 to 5, a first embodiment of the electronic lock is adapted to be mounted on a door panel 100 of a door (not shown). In this embodiment, the door panel 100 is, e.g., an aluminum door but is not limited to an aluminum door. The electronic lock can be unlocked by a key 200 or a card 300 that includes a sensor tag 301 storing an identification data.

The electronic lock includes a lock device 2 and a clutch mechanism 3. The lock device 2 includes a face plate 21, a lock cylinder 22 and an inner knob 23. The face plate 21 is mounted to the door panel 100 and includes a bolt member 211. In this embodiment, the bolt member 211 is a hook. The lock cylinder 22 is mounted to the door panel 100 and includes a latch member 221 and is formed with a lock hole 222. The latch member 221 extends along an axis (L) that extends along an in-out direction (X) and is operable to rotate about the axis (L) to drive the bolt member 211 to lock and unlock the lock device 2. When the key 200 is inserted into the lock hole 222 and drives the lock cylinder 22 to rotate, the bolt member 211 is driven to lock and unlock the lock device 2. Since how the bolt member 211 is driven to lock and unlock by the lock cylinder 22 is well known in the art, further details of the same are omitted for the sake of brevity. The inner knob 23 is mounted on the door panel 100, is opposite to the clutch mechanism 3 along the in-out direction (X), and is operable to rotate to drive the bolt member 211 to lock and unlock the lock device 2. In other embodiments, the clutch mechanism 3 of the present disclosure can be mounted to a door panel with a lock device mounted thereon to constitute an electronic lock without replacing the existing lock device. Thus, it is relatively convenient to install the clutch mechanism on a door with an existing lock device to constitute an electronic lock and the cost of such electric lock is lower than that of conventional electronic lock that requires to replace the entire lock device.

Figure 6:
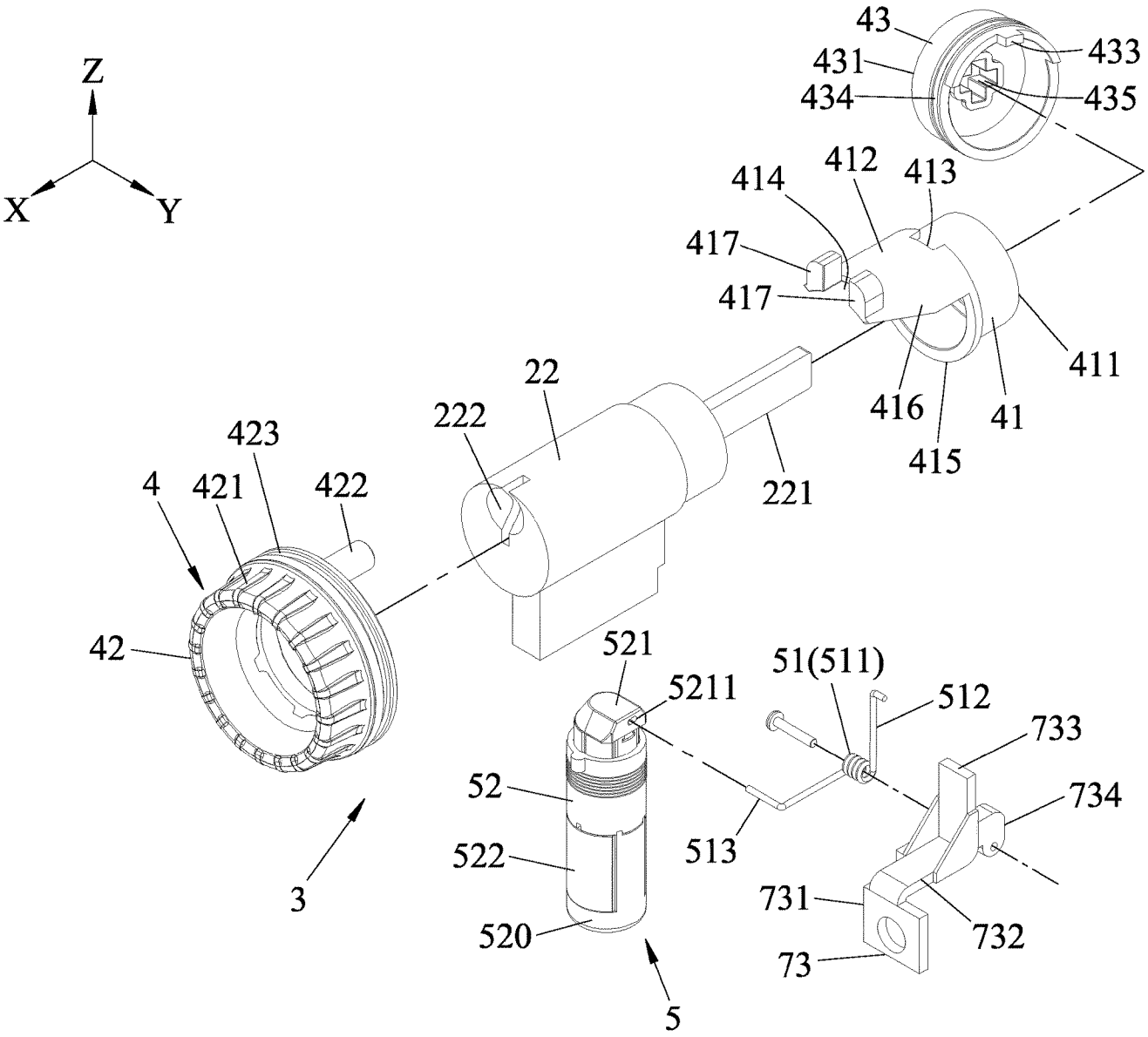
FIG. 6 is an exploded perspective view a clutch unit, a driving unit, and a lock cylinder of the first embodiment.
Figure 7:
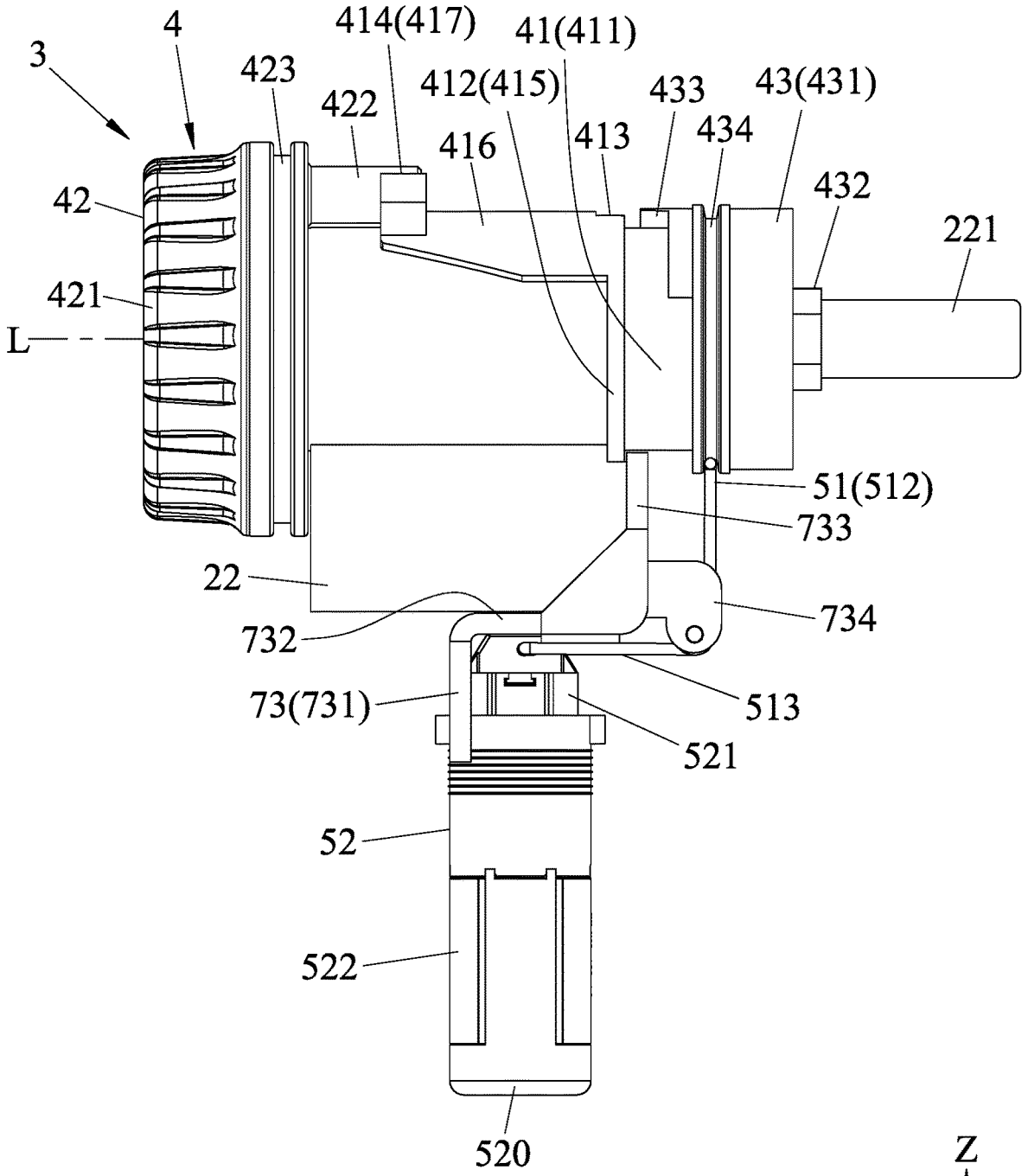
FIG. 7 is a schematic side view of the clutch unit and the driving unit shown in FIG. 6.

Further referring to FIGS. 6 to 7, the clutch mechanism 3 is mounted to the lock cylinder 22 and includes a clutch unit 4, a driving unit 5, a control module 6, and a housing unit 7.

The clutch unit 4 includes a rotatable seat 41, an accessible knob 42, and a clutch seat 43. The rotatable seat 41 is rotatably sleeved on the lock cylinder 22 and permits the latch member 221 to extend therethrough. The accessible knob 42 is rotatably sleeved on the lock cylinder 22 and engages an end portion of the rotatable seat 41 so as to drive the rotatable seat 41 to rotate about the axis (L) when being rotated by a user. The clutch seat 43 detachably engages an opposite end portion of the rotatable seat 41 and is movable relative to the latch member 221 along the in-out direction (X).

Figure 8:
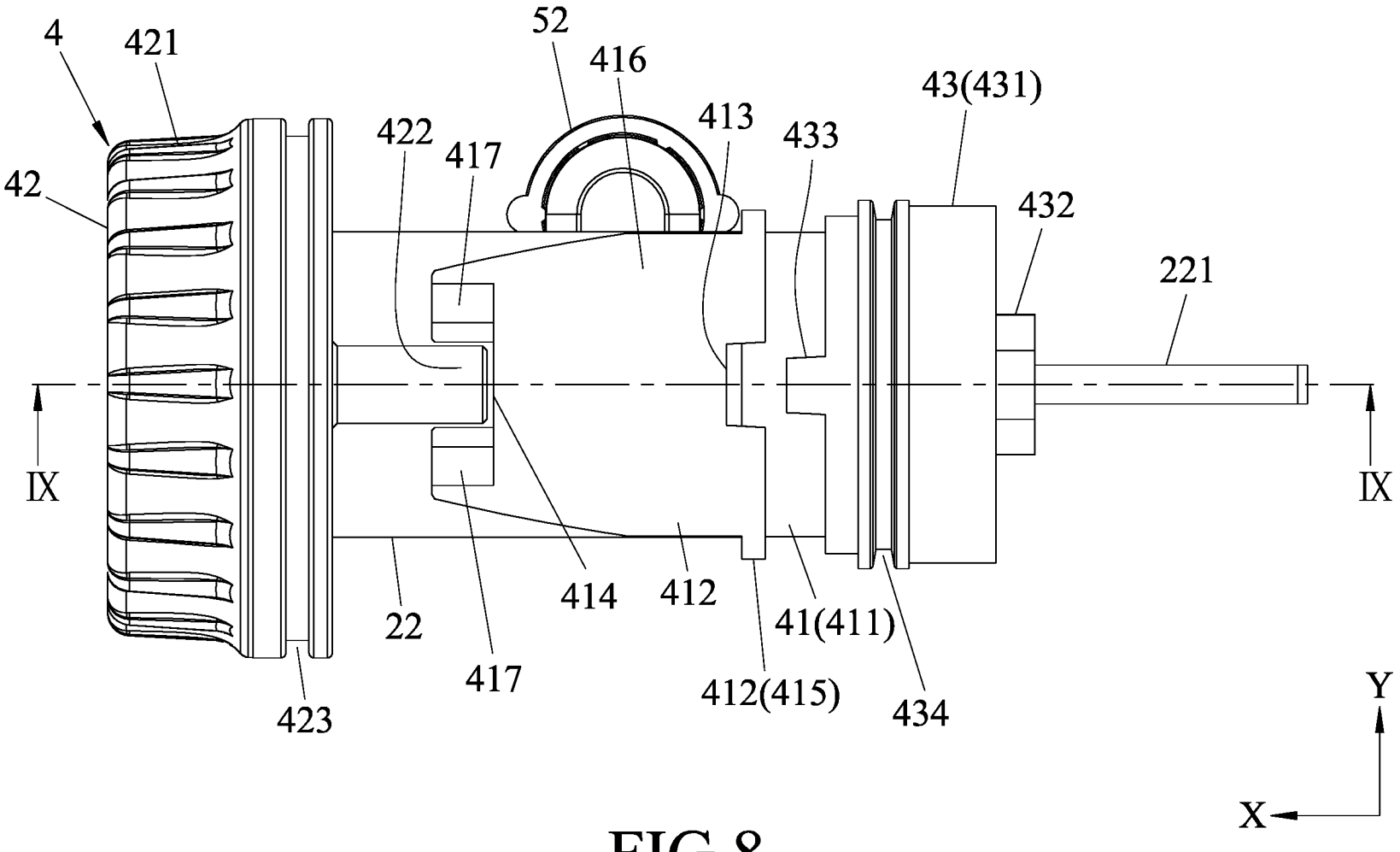
FIG. 8 is a schematic top view of the clutch unit and the driving unit shown in FIG. 6.

Further referring to FIG. 8, the rotatable seat includes a bush section 411 and a connecting section 412. The bush section 411 is sleeved on the lock cylinder 22. The connecting section 412 extends from the bush section 411 away from the clutch seat 43 along the in-out direction (X), and has a first engaging portion 413 proximate to the bush section 411 and adjacent to the clutch seat 43, and a first coupling portion 414 distal from the bush section 411 and adjacent to the accessible knob 42.

The connecting section 412 has an end formed with an annular flange 415 extending radially and outwardly therefrom. The connecting section 412 includes a connecting plate 416 and two connecting bocks 417. The connecting plate 416 extends from a portion of the annular flange 415 along the in-out direction (X) toward the accessible knob 42. The connecting blocks 417 are spaced apart from each other along a left-right direction (Y) transverse to the in-out direction (X), extend from the connecting plate 416, and define the first coupling portion 414. In this embodiment, the first coupling portion 414 is, e.g., a groove formed between the connecting blocks 417, and the first engaging portion 413 is, e.g., a notch, but the first coupling portion 414 and the first engaging portion 413 may be modified according to demand.

The accessible knob 42 includes an annular portion 421 that is sleeved on the lock cylinder 22 and that is adapted to be operated by hand, and a second coupling portion 422 that is non-rotatably coupled to the first coupling portion 414 of the rotatable seat 41. In this embodiment, the second coupling portion 422 is clamped by the connecting blocks 417.

The clutch seat 43 includes a sleeve ring portion 431, a guiding portion 432 (see FIG. 7), and a second end engaging portion 433. The sleeve ring portion 431 is sleeved on the bush section 411 of the rotatable seat 41 and is formed with an annular groove 434. The guiding portion 432 is formed with a limiting slot 435 configured to engage the latch member 221 of the lock cylinder 2 so as to drive the latch member 221 to rotate and unlock the electronic lock. The second end engaging portion 433 is opposite to the guiding portion 432 along the in-out direction (X) and detachably engages the first engaging portion 413. In this embodiment, the limiting slot 435 has a criss-cross cross section and can evenly distribute force exerted on the latch member 221 when the latch member 221 is rotated. In other embodiments, the limiting slot 435 is configured to be complementary in shape with the latch member 221 and can be shaped as other non-circular configuration as long as the latch member 221 can be driven to rotate through engagement with the limiting slot 435 when the inner knob 23 is rotated. In this embodiment, the second end engaging portion 433 is a protrusion extending toward the first engaging portion 413, and the first engaging portion 413 is a notch engaging the second end engaging portion 433. In other embodiments, the first engaging portion 413 is a protrusion and the second end engaging portion 433 is a notch.

Figure 9:
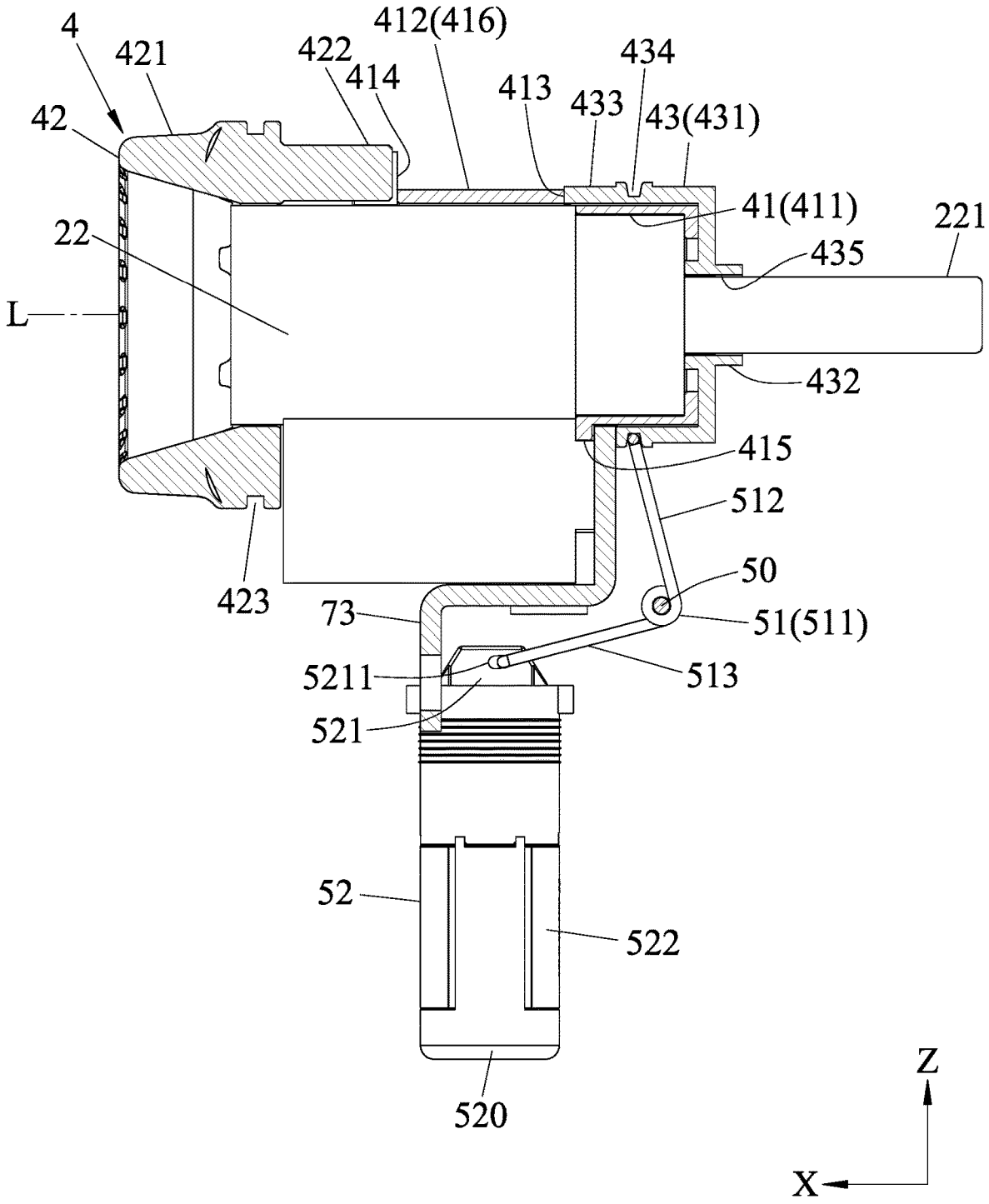
FIG. 9 is a schematic sectional view taken along line IX-IX in FIG. 8, illustrating a clutch seat of the clutch unit being at an unlock position.
Figure 10:
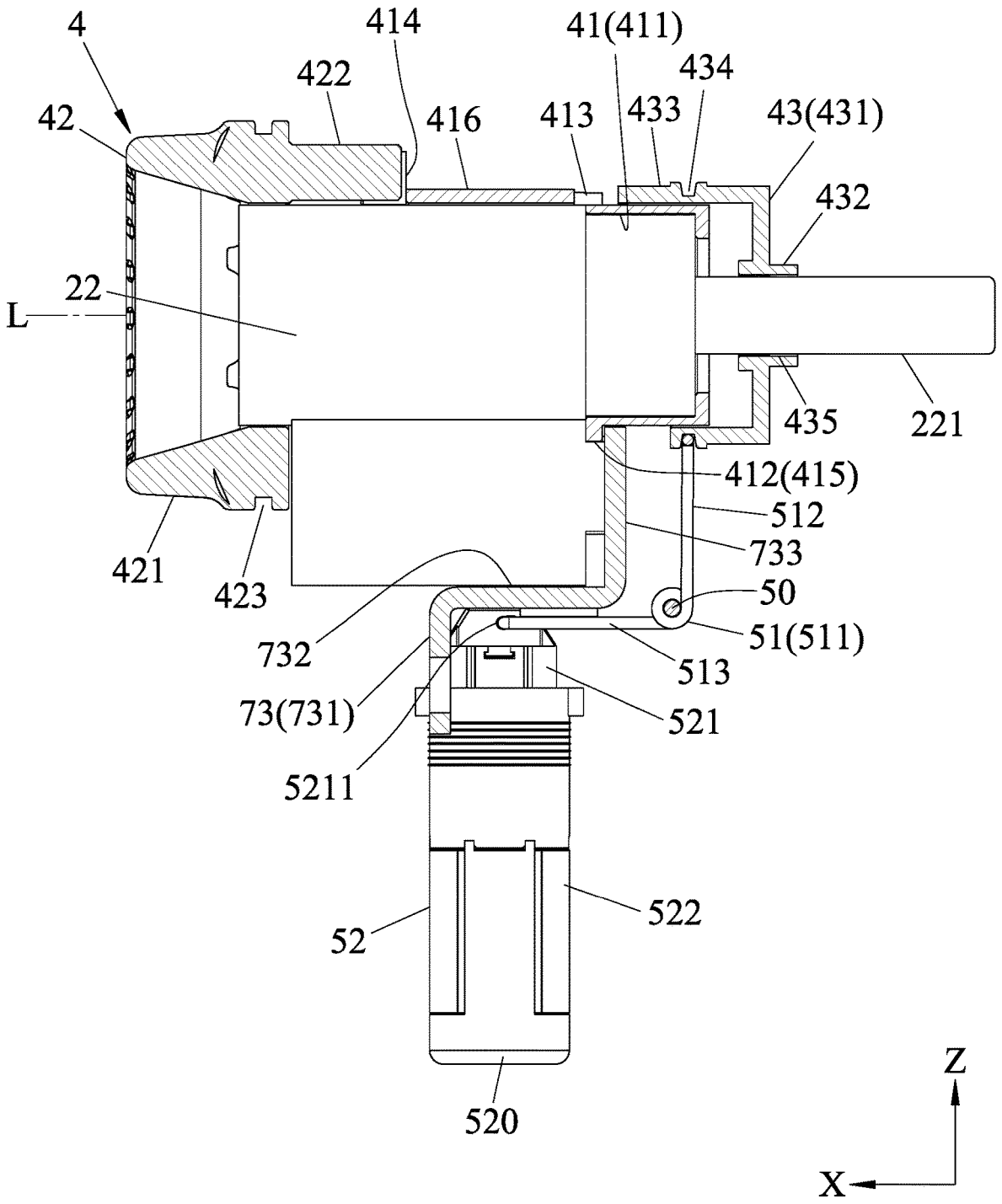
FIG. 10 is similar to FIG. 9, but illustrating the clutch seat being at a lock position.

Further referring to FIGS. 9 and 10, the clutch seat 43 is movable relative to the rotatable seat 41 between an unlock position (FIG. 9) and a lock position (FIG. 10), where the second end engaging portion 433 engages and disengages the first engaging portion 413, respectively. As shown in FIG. 9, when the clutch seat 43 is at the unlock position, the second end engaging portion 433 engages the first engaging portion 413, so that the accessible knob 42 can be rotated by a user to drive rotation of the rotatable seat 41, the clutch seat 43, and the latch member 221, thereby allowing the bolt member 211 to lock and unlock the lock device 2. As shown in FIG. 10, when the clutch seat 43 is at the lock position, since the second engaging portion 433 disengages the first engaging portion 413, the clutch seat 43 cannot be driven by the accessible knob 42 to rotate, so that the latch member 221 cannot be rotated.

The driving unit 5 is for driving the clutch seat 43 to move between the lock and unlock positions. Specifically, the driving unit 5 includes a pivot pin 50, a biasing member 51, a driving device 52 and a battery 53. The biasing member 51 includes a main body 511, a first arm 512 and a second arm 513. The pivot pin 50 extends through the main body 511. The first arm 512 extends from the main body 511 along an up-down direction (Z) transverse to the in-out direction (X) and the left-right direction (Y), and engages the annular groove 434 in the sleeve ring portion 431 of the clutch seat 43. The second arm 513 extends from the main body 511 along the in-out direction (X) and is connected to the driving device 52. The driving device 52 is operable to drive the biasing member 51 to move the clutch seat 43 between the unlock position and the lock position.

In this embodiment, the driving device 52 includes a fixed body 520, a movable member 521 and a driving member 522. The movable member 521 is movable relative to the fixed body 520 along the up-down direction (Z) and has a horizontal slide slot 5211 that permits the second arm 513 of the biasing member 51 to extend movably therethrough so as to drive the first arm 512 to pivot about the pivot pin 50, thereby allowing the clutch seat 43 to be moved between the unlock position and the lock position. The driving member 522 is disposed within the fixed body 520 and is connected to the movable member 521 for driving movement of the movable member 521 relative to the fixed body 520. For example, the driving member 522 drives the movable member 521 to move along the up-down direction (Z) by cooperation of a motor (not shown) with a threaded rod (not shown).

As shown in FIG. 9, when the movable member 521 moves downwardly relative to the fixed body 520 along the up-down direction (Z), the second arm 513 is pulled downwardly such that the biasing member 51 pivots about the pivot pin 50 in a counterclockwise direction and the first arm 512 drives the clutch seat 43 to move toward and engage the first engaging portion 413 of the rotatable seat 41.

As shown in FIG. 10, when the movable member 521 moves upwardly relative to the fixed body 520 along the up-down direction (Z), the second arm 513 is pushed upwardly such that the biasing member 51 pivots about the pivot pin 50 in a clockwise direction and the first arm 512 drives the clutch seat 43 to move away from and disengage the first engaging portion 413 of the rotatable seat 41.

Figure 11:
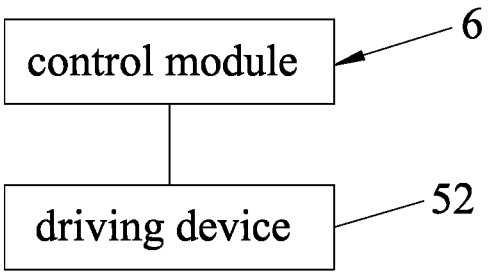
FIG. 11 is a block diagram of a control module and the driving unit of the first embodiment.

Referring to FIG. 11, the control module 6 is communicatively connected to the driving device 52 of the driving unit 5 and is configured to control operation of the driving unit 5 to drive the biasing member 51 to move the clutch seat 43 between the unlock position and the lock position. Specifically, the control module 6 is configured to transmit a lock instruction signal and an unlock instruction signal to the driving member 522 of the driving unit 5 so as to move the clutch seat 43 between the lock and unlock positions. The control module 6 is further configured to sense and identify the identification data stored in the sensor tag 301 of the card 300 and to transmit the unlock instruction signal to the driving member 522 when the identification data is identified to be valid. In this embodiment, the control module 6 communicates with the card 300 using radio frequency identification techniques.

In one embodiment, when the control module 6 transmits the unlock instruction signal to the driving member 522 upon receipt of the identification data from the card 300, the driving member 522 is configured to remain the clutch seat 43 at the unlock position for a predetermined time period. In this embodiment, the predetermined time period is five seconds.

When the clutch seat 43 is at the unlock position and when the accessible knob 42 is not operated to rotate for the predetermined time period, the control module 6 is configured to transmit the lock instruction signal to the driving member 522 to drive the clutch seat 43 to move back to the lock position. In this way, when the card 300 is used to unlock the electronic lock, the clutch seat 43 moves back to the lock position after the predetermined time period has elapsed and thus a relatively high security is provided.

Additionally, the control module 6 of the electronic lock of the first embodiment may include a communicating module capable of perform wireless communication with a mobile device (not shown) such as a smart phone using wireless technology of Bluetooth® and/or Wi-Fi, etc. The mobile device is configured to transmit an unlock signal to the control module 6 to drive the control module 6 to transmit the unlock instruction signal to the driving member 522 so as to drive the clutch seat 43 to move to the unlock position.

In this embodiment, the control module 6 includes a microcontroller or a controller such as, but not limited to, a single core processor, a multi-core processor, a dual-core mobile processor, a microprocessor, a microcontroller, a digital signal processor (DSP), a field-programmable gate array (FPGA), an application specific integrated circuit (ASIC), a radio-frequency integrated circuit (RFIC), etc.

Referring back to FIGS. 3 to 5, the housing unit 7 includes an inner cover 71, an outer cover set 72, a limiting member 73, and a knob seat 74. The inner cover 71 is mounted to an inner side of the door panel 100 and permits the inner knob 23 to be mounted thereon. The outer cover set 72 includes a cover 721 and an outer cover seat 722. The cover 721 covers the rotatable seat 41, the clutch seat 43, the biasing member 51, and the driving member 522 and has an inner surface 723 and an outer surface 724. The inner surface 723 faces the clutch seat 43 and permits the limiting member 73 to be mounted fixedly thereto. The outer surface 724 faces away from the clutch seat 43 along the in-out direction (X) and permits the knob seat 74 to be mounted thereon. The outer cover seat 722 includes a battery slot 725 adapted to accommodate the battery 53 for supplying power to the driving unit 5, and a battery lid 726 detachably covering the battery slot 725. Further, the control module 6 is mounted in a space defined in the outer cover seat 722.

Referring to FIGS. 4 to 7, the limiting member 73 is provided for mounting the biasing member 51 and includes a fixed portion 731, a base portion 732, a blocking plate portion 733 and a positioning portion 734. The fixed portion 731 is connected fixedly to the inner surface 723 of the cover 721. The base portion 732 extends from the fixed portion 731 toward the clutch seat 43 along the in-out direction (X) for mounting the lock cylinder 22 thereon. The blocking plate portion 733 extends along the up-down direction (Z) from one end of the base portion 732 opposite to the fixed portion 731 along the in-out direction (X), is disposed between the connecting section 412 of the rotatable seat 41 and the sleeve ring portion 431 of the clutch seat 43 such that the clutch seat 43 is spaced apart from the rotating seat 41 so as to prevent impact on the rotatable seat 41 when the clutch seat 43 moves toward the rotatable seat 41. The positioning portion 734 extends along the in-out direction (X) from the blocking plate portion 733 toward the clutch seat 43 for mounting of main body 511 of the biasing member 51 thereon. Specifically, the pivot pin 50 extends through the main body 511 and the positioning portion 734 such that the biasing member 51 is pivotally connected to the limiting member 73.

Figure 12:
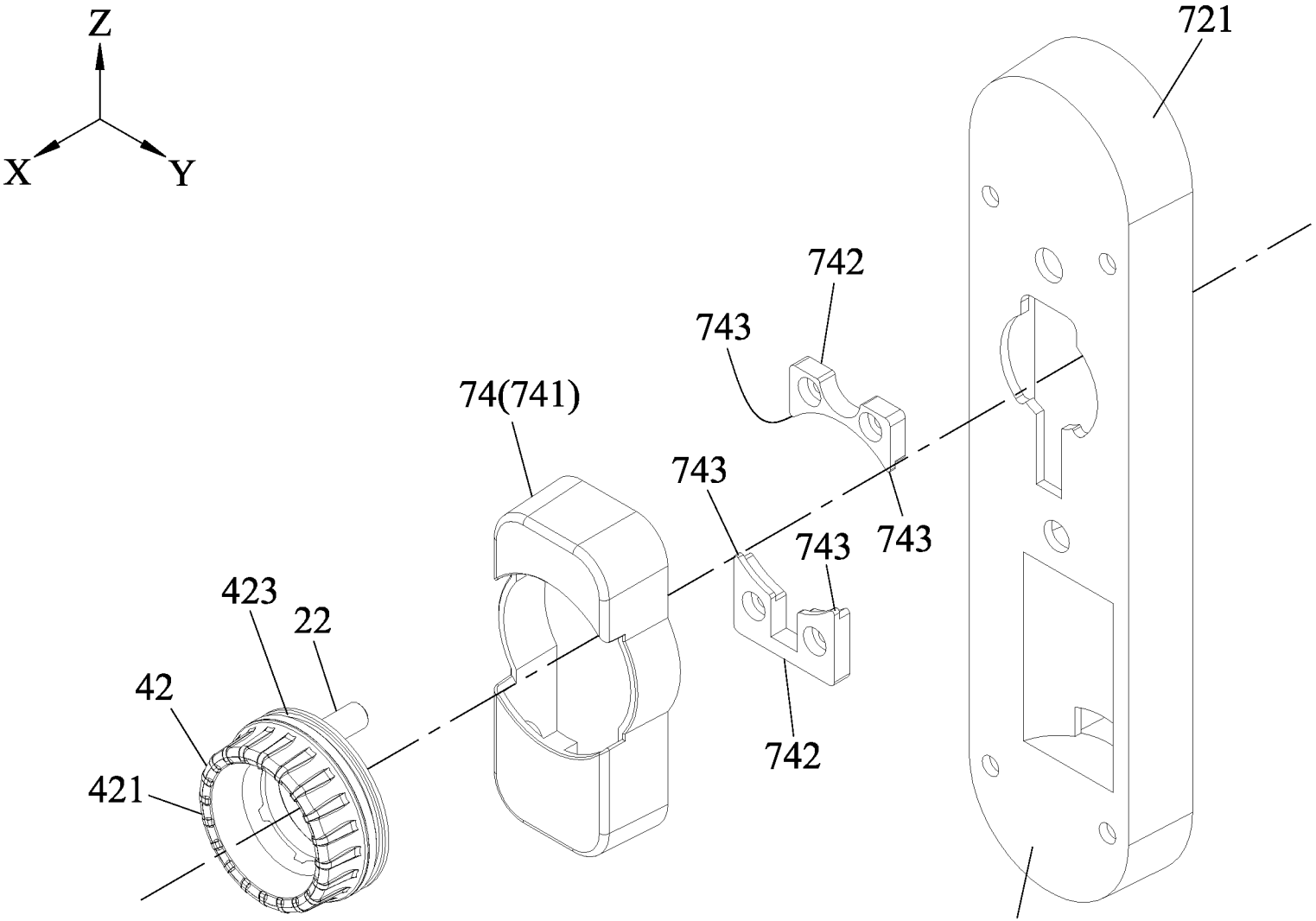
FIG. 12 is an exploded perspective view illustrating an accessible knob of the clutch unit mounted to a knob seat of a housing unit of the first embodiment.

Referring to FIG. 12, the knob seat 74 permits the accessible knob 42 to be mounted thereon, is mounted on the outer surface 724 of the cover 721, and is disposed between the cover 721 and the outer cover seat 722. The knob seat 74 includes a seat body 741 and two limiting plates 742 spaced apart from each other along the up-down direction (Z) and detachably mounted to the seat body 741.

The accessible knob 42 is rotatably mounted to the seat body 741 of the knob seat 74, includes an external portion exposed outwardly of the seat body 741 to be operated by a user, and has an outer surface that is formed with an annular groove 423 engaging a portion of each of the limiting plates 742 so as to retain the accessible knob 42 in the knob seat 74. In this embodiment, each of the limiting plates 742 is connected detachably to the seat body 741 by a plurality of screws (not shown), and includes a pair of limiting ribs 743 extending into the annular grove 423 of the accessible knob 42 such that the accessible knob 42 is retained in the knob seat 74. Note that the number of the limiting plates 742 is not limited to the example described herein and may be one or more than two in other embodiments of the present disclosure.

Figure 13:
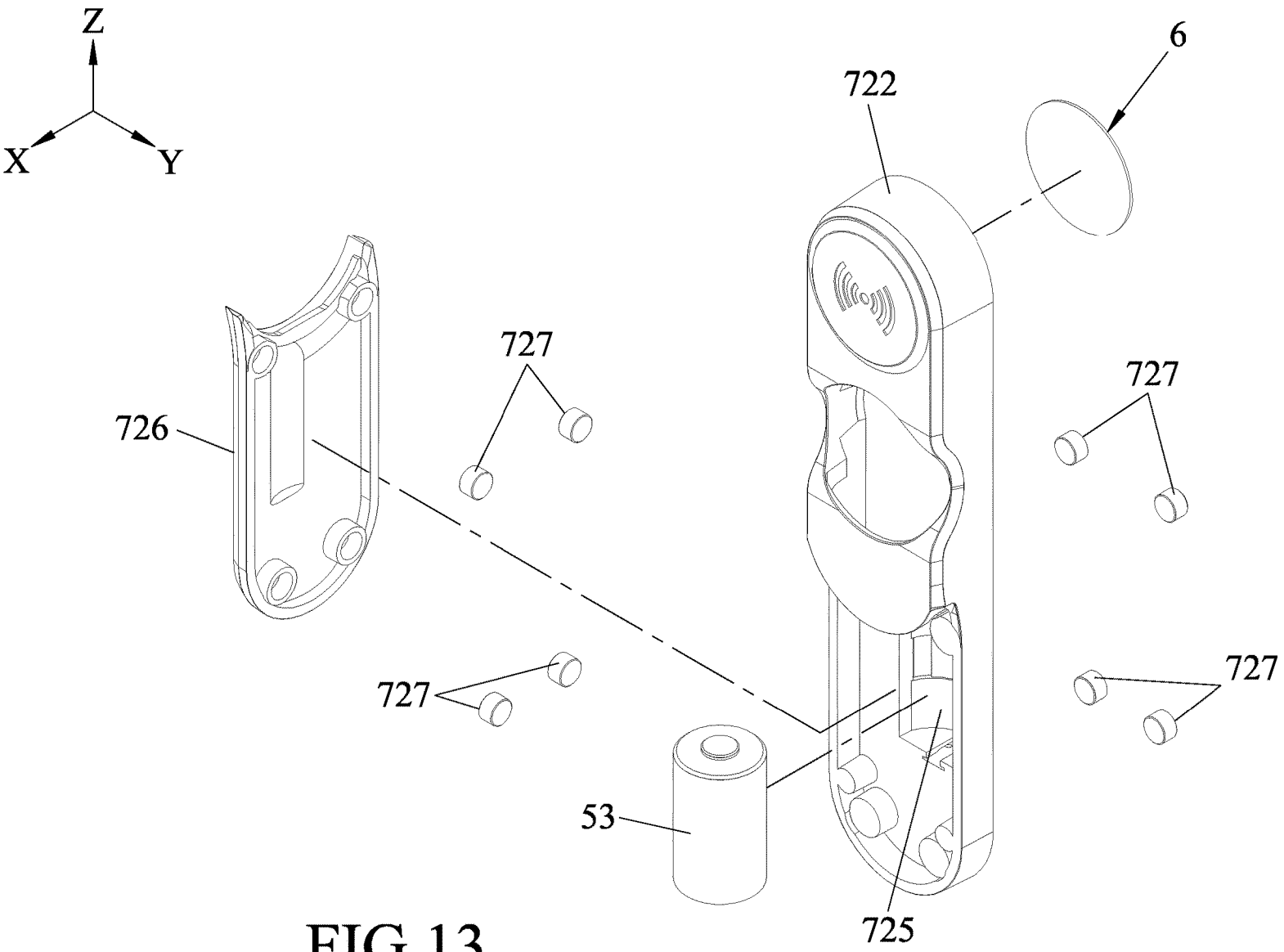
FIG. 13 is an exploded perspective view illustrating the control module of the clutch mechanism mounted to an outer cover seat of the housing unit, a battery being mounted in a battery slot of the outer cover seat, and a battery lid detachably covering the battery slot.

Further referring to FIG. 13, in this embodiment, the outer cover set 72 further includes a plurality of magnets 727 mounted to the outer cover seat 722 and the battery lid 726 such that the battery lid 726 detachably covers the battery slot 725 by the magnets 727.

Figure 14:
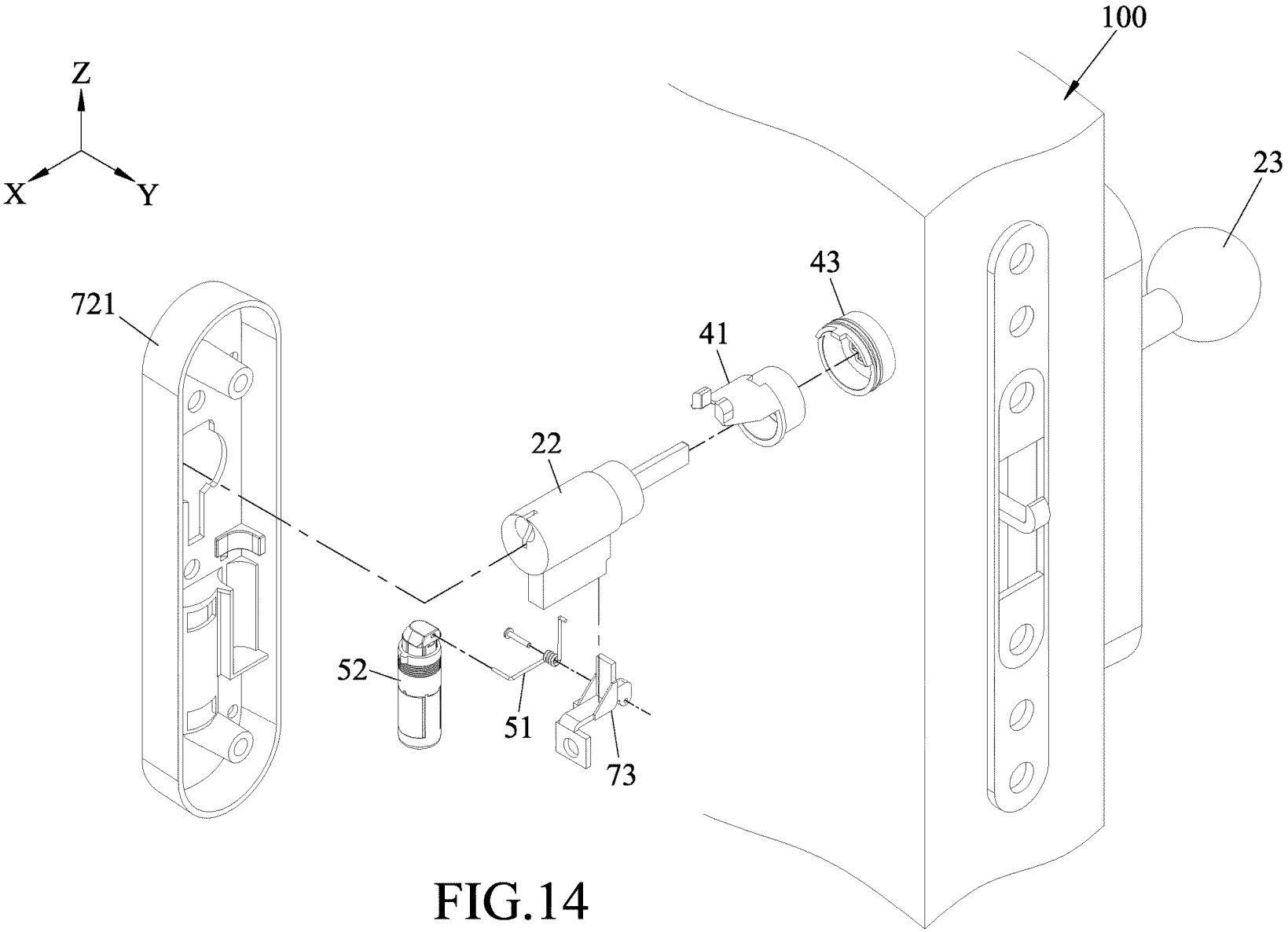
FIGS. 14 to 16 illustrate the procedures for installing the first embodiment on a door.
Figure 15:
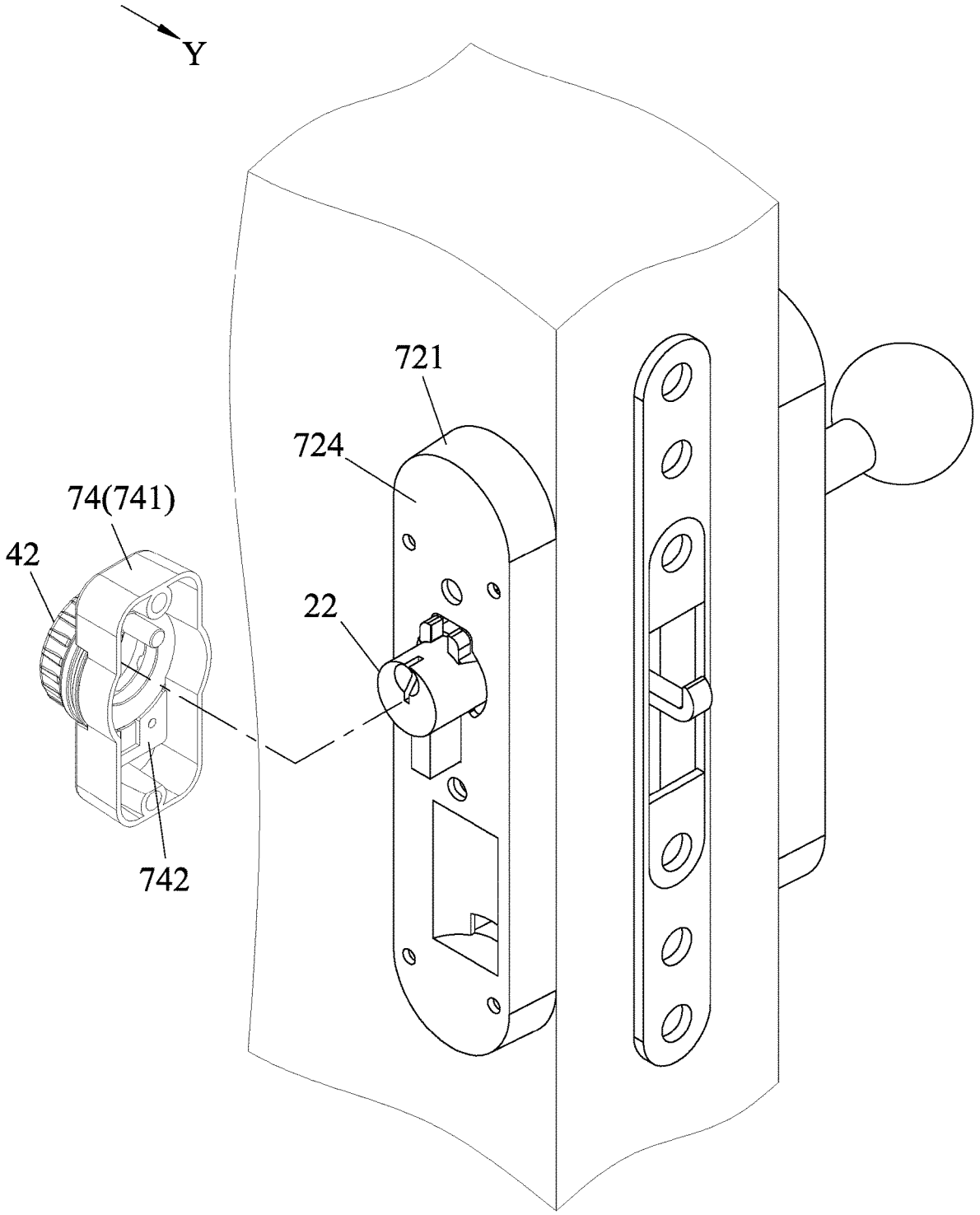
Figure 16:
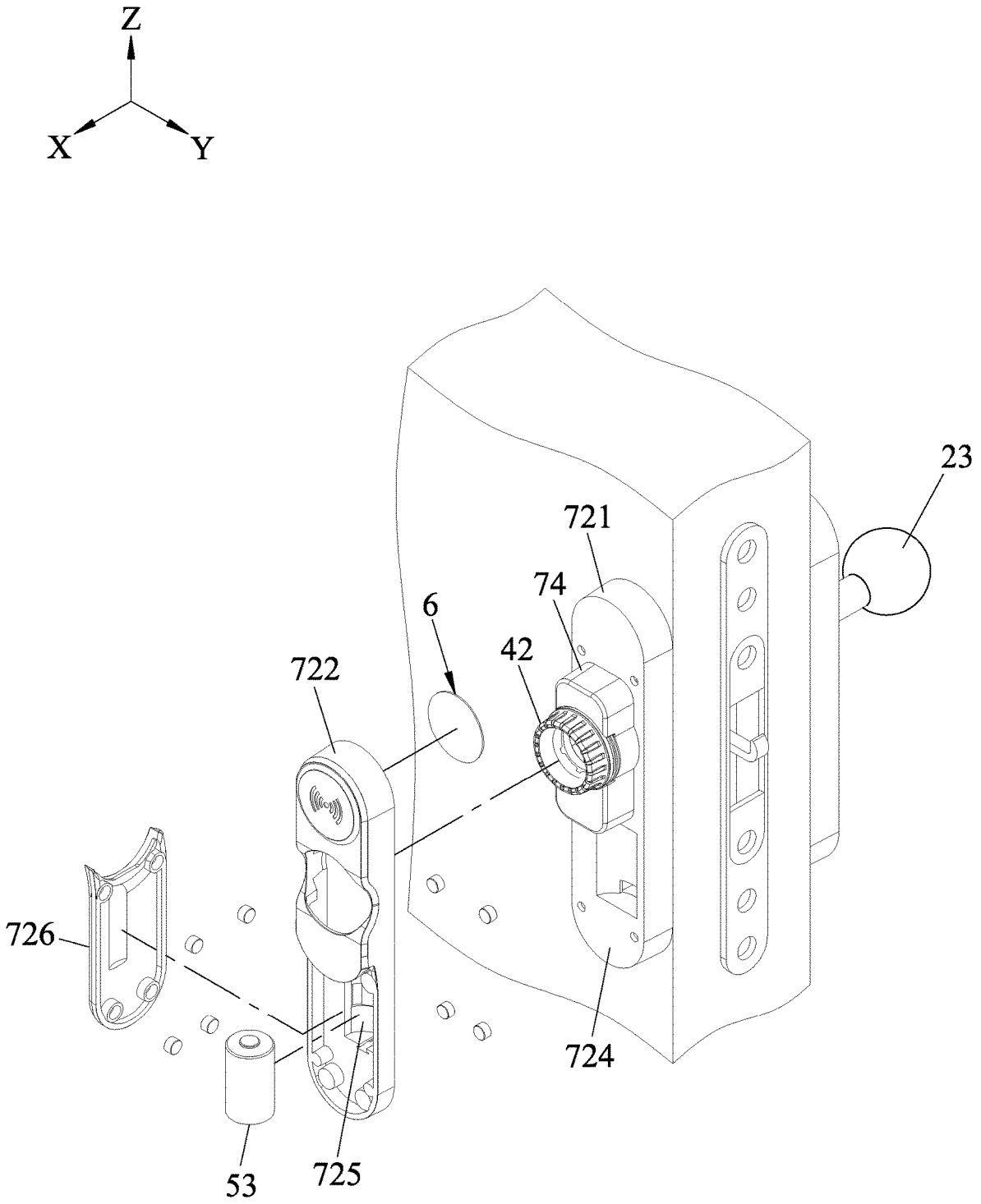

Referring to FIGS. 14 to 16, the procedures for installing the electronic lock onto the door panel 100 is to be described in the following. First, the rotatable seat 41 and the clutch seat 43 are sequentially sleeved on the lock cylinder 22. Then, the biasing member 51 is brought to be mounted to the limiting member 73 and connected to the clutch seat 43 and the driving device 52. After that, the lock cylinder 22 is mounted to an outer side surface of the door panel 100 opposite to the inner knob 23 along the in-out direction (X) such that a portion of the lock cylinder 22 is exposed outwardly of the door panel 100.

Subsequently, as shown in FIG. 15, the cover 721 covers the rotatable seat 41, the clutch seat 43, the limiting member 73, the biasing member 51 and a portion of the lock cylinder 22 such that a portion of the lock cylinder 22 is exposed outwardly of the cover 721. The accessible knob 42 is brought to be mounted to the seat body 741 of the knob seat 74, the limiting plates 742 are brought to be disposed in the seat body 741 of the knob seat 74 such that the limiting ribs 743 (see FIG. 12) engage the annular groove 423 formed in the accessible knob 42 so as to retain the accessible knob 42 in the knob seat 74. Then, the accessible knob 42 and the knob seat 74 are mounted to the outer surface 724 of the cover 721.

As shown in FIG. 16, the control module 6 is brought to be mounted in the outer cover seat 722 and the battery 53 is brought to be disposed in the battery slot 725, and then the battery lid 726 is brought to cover the battery slot 725. Finally, the housing holder 722 is brought to be mounted on the cover 721 to complete the installation of the electronic lock.

The inner knob 23 can be rotated by a person located inside of the door panel 100 to lock and unlock the electronic lock, whereas the card 300, the key 200 or a mobile device communicating with the control module 6 can be used by a user located outside of the door panel 100 to unlock the electronic lock. In case that the battery 53 is consumed or the user forgets to bring the card 300, the electronic lock can be unlocked by using the key 200.

Figure 17:
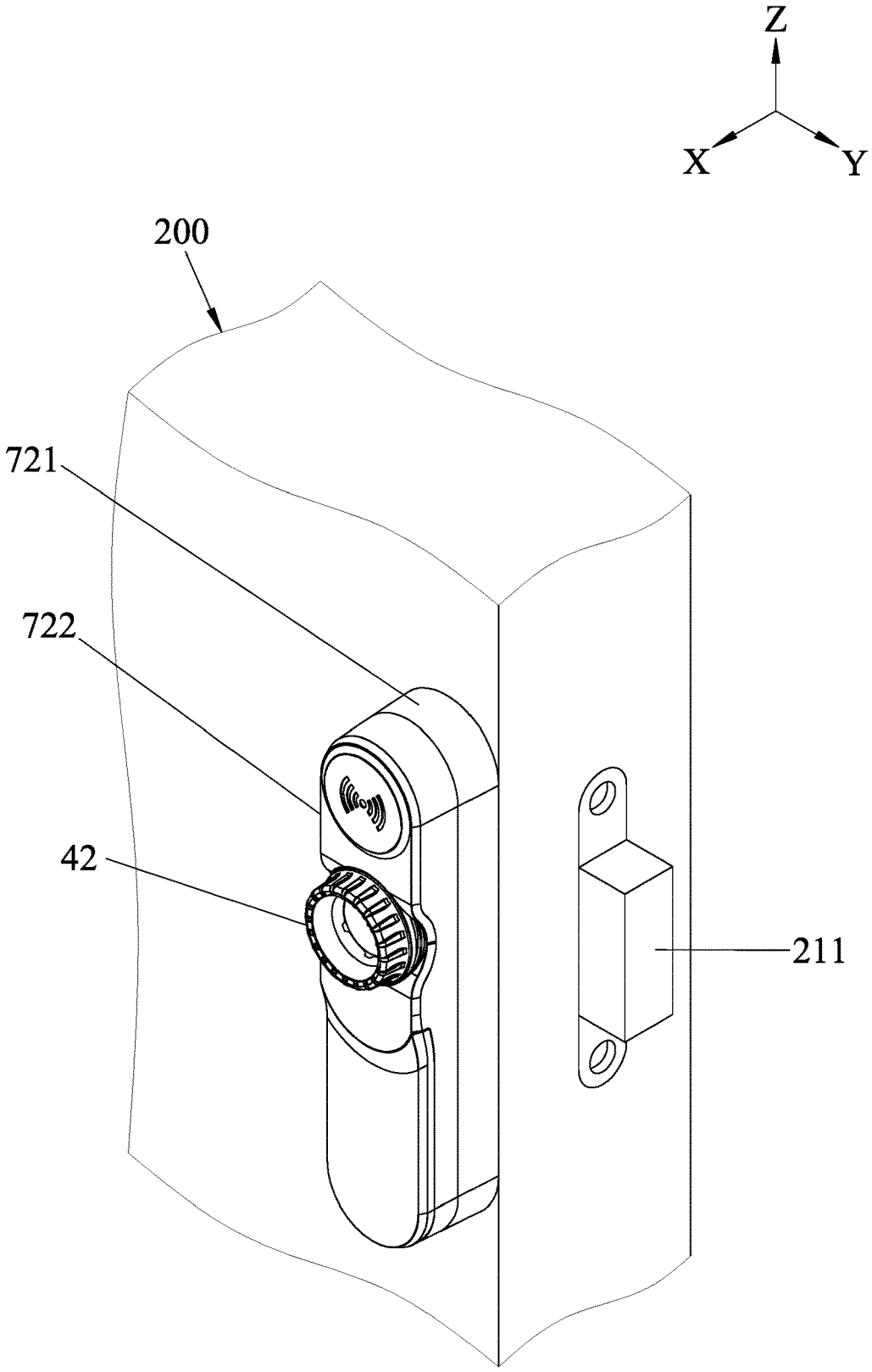
FIG. 17 is a fragmentary schematic perspective view illustrating a second embodiment of the electronic lock according to the present disclosure being mounted on a door.

By virtue of the structures of the bush section 411 of the rotating seat 41 sleeved on the lock cylinder 22, the accessible knob 42 rotatably sleeved on the lock cylinder 22 and operable to drive the rotating seat 41 to rotate, the clutch seat 43 detachably engaging the rotatable seat 41, and the guiding portion 432 detachably engaging the latch member 221, the clutch mechanism 3 of the present disclosure is relatively convenient to install and occupies a relatively small space. In this way, the clutch mechanism 3 can be mounted on a door panel with a relatively thin thickness. In addition, the clutch mechanism 3 can be mounted to a door panel with an existing lock device to constitute an electronic lock without replacing the lock device. Thus, since the clutch mechanism 3 is mounted on the outside of the lock cylinder 22, it is convenient to install the clutch mechanism 3. Further, the structure of the lock device 2 enables a user to unlock the electronic lock using the key 200 in case that the battery 53 is consumed or the user forgets to bring the card 300. Referring to FIG. 17, a second embodiment of the electronic lock of the present disclosure is similar to the first embodiment and the difference therebetween resides in that the bolt member 211 of the second embodiment is a deadbolt and the inner knob 23 shown in FIG. 4 is omitted. The electronic lock of the second embodiment is adapted to be mounted to a panel 200 of a cabinet (not shown) or a drawer (not shown).

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A clutch mechanism of an electronic lock adapted to be mounted on a lock cylinder, the lock cylinder including a latch member extending along an axis that extends along an in-out direction and operable to rotate about the axis to lock and unlock the electronic lock, said clutch mechanism comprising:

a clutch unit including:

a rotatable seat adapted to be rotatably sleeved on the lock cylinder and permitting the latch member to extend therethrough, an accessible knob adapted to be rotatably sleeved on the lock cylinder and engaging an end portion of said rotatable seat so as to drive said rotatable seat to rotate about the axis, and a clutch seat detachably engaging an opposite end portion of said rotatable seat and adapted to be movable relative to the latch member along the in-out direction, said rotatable seat including a bush section that is adapted to be sleeved on the lock cylinder, and a connecting section that extends from said bush section away from said clutch seat along the in-out direction and that has a first engaging portion adjacent to said clutch seat, and a first coupling portion adjacent to said accessible knob, said accessible knob including an annular portion adapted to be sleeved on the lock cylinder, and a second coupling portion non-rotatably coupled to said first coupling portion of said rotatable seat, said clutch seat including a sleeve ring portion sleeved on said bush section of said rotatable seat, and a second engaging portion detachably engaging said first engaging portion, said clutch seat being movable relative to said rotatable seat between an unlock position and a lock position, where said second engaging portion engages and disengages said first engaging portion, respectively; and a driving unit including a pivot pin, a biasing member and a driving device, said biasing member including a main body, through which said pivot pin extends, a first arm which extends from said main body along an up-down direction transverse to the in-out direction and which engages said clutch seat, and a second arm which extends from said main body along the in-out direction and which is connected to said driving device, said driving device being operable to drive said biasing member to move said clutch seat between the unlock position and the lock position; and a control module communicatively connected to said driving unit and configured to control operation of said driving unit to drive said biasing member to move said clutch seat between the unlock position and the lock position;

wherein said sleeve ring portion of said clutch seat is formed with a limiting slot adapted to engage the latch member of the lock cylinder so as to drive the latch member to rotate and unlock the electronic lock.

2. The clutch mechanism as claimed in claim 1, wherein said bush section has an end formed with an annular flange extending radially and outwardly therefrom, and said connecting section includes a connecting plate extending from a portion of said annular flange along the in-out direction toward said accessible knob, and two connecting blocks spaced apart from each other along a left-right direction transverse to the up-down direction and the in-out direction, extending from said connecting plate, and defining said first coupling portion.

3. The clutch mechanism as claimed in claim 1, wherein said driving device includes: a fixed body; a movable member movable relative to said fixed body along the up-down direction and having a horizontal slide slot that permits said second arm of said biasing member to extend movably therethrough, so as to drive said first arm to pivot about said pivot pin such that said clutch seat is moved between the unlock position and the lock position; and a driving member disposed within said fixed body and connected to said movable member for driving movement of said movable member relative to said fixed body.

4. The clutch mechanism as claimed in claim 1, wherein said sleeve ring portion of said clutch seat is formed with an annular groove engaging said first arm of said biasing member.

5. The clutch mechanism as claimed in claim 1, further comprising a housing unit including a knob seat and an outer cover set that covers said rotatable seat, said clutch seat and said driving unit, and that includes a cover having an outer surface facing away from said clutch seat along the in-out direction and permitting said knob seat to be mounted thereon, said knob seat including a seat body and at least one limiting plate detachably mounted to said seat body, said accessible knob being rotatably mounted to said knob seat and having an outer surface that is formed with an annular groove engaging a portion of said limiting plate so as to retain said accessible knob in said knob seat.

6. The clutch mechanism as claimed in claim 1, further comprising a housing unit including an outer cover set that covers said rotatable seat, said clutch seat and said driving unit, and that includes an outer cover seat including a battery slot adapted to accommodate a battery therein for supplying power to said driving unit, and a battery lid detachably covering said battery slot.

7. A clutch mechanism of an electronic lock adapted to be mounted on a lock cylinder, the lock cylinder including a latch member extending along an axis that extends along an in-out direction and operable to rotate about the axis to lock and unlock the electronic lock, said clutch mechanism comprising:

a clutch unit including:

a rotatable seat adapted to be rotatably sleeved on the lock cylinder and permitting the latch member to extend therethrough, an accessible knob adapted to be rotatably sleeved on the lock cylinder and engaging an end portion of said rotatable seat so as to drive said rotatable seat to rotate about the axis, and a clutch seat detachably engaging an opposite end portion of said rotatable seat and adapted to be movable relative to the latch member along the in-out direction, said rotatable seat including a bush section that is adapted to be sleeved on the lock cylinder, and a connecting section that extends from said bush section away from said clutch seat along the in-out direction and that has a first engaging portion adjacent to said clutch seat, and a first coupling portion adjacent to said accessible knob, said accessible knob including an annular portion adapted to be sleeved on the lock cylinder, and a second coupling portion non-rotatably coupled to said first coupling portion of said rotatable seat, said clutch seat including a sleeve ring portion sleeved on said bush section of said rotatable seat, and a second engaging portion detachably engaging said first engaging portion, said clutch seat being movable relative to said rotatable seat between an unlock position and a lock position, where said second engaging portion engages and disengages said first engaging portion, respectively; and a driving unit including a pivot pin, a biasing member and a driving device, said biasing member including a main body, through which said pivot pin extends, a first arm which extends from said main body along an up-down direction transverse to the in-out direction and which engages said clutch seat, and a second arm which extends from said main body along the in-out direction and which is connected to said driving device, said driving device being operable to drive said biasing member to move said clutch seat between the unlock position and the lock position;

a control module communicatively connected to said driving unit and configured to control operation of said driving unit to drive said biasing member to move said clutch seat between the unlock position and the lock position; and a housing unit, said housing unit being configured for mounting of said driving unit and including a limiting member and an outer cover set that covers said rotatable seat, said clutch seat and said driving unit, and that includes a cover having an inner surface facing said clutch seat and permitting said limiting member to be mounted fixedly thereto, said limiting member including a blocking plate portion extending along the up-down direction and disposed between said connecting section of said rotatable seat and said sleeve ring portion of said clutch seat such that said clutch seat is spaced apart from said rotating seat, so as to prevent impact on said rotatable seat when said clutch seat moves toward said rotatable seat.

8. The clutch mechanism as claimed in claim 7, wherein said bush section has an end formed with an annular flange extending radially and outwardly therefrom, and said connecting section includes a connecting plate extending from a portion of said annular flange along the in-out direction toward said accessible knob, and two connecting blocks spaced apart from each other along a left-right direction transverse to the up-down direction and the in-out direction, extending from said connecting plate, and defining said first coupling portion.

9. The clutch mechanism as claimed in claim 7, wherein said driving device includes: a fixed body; a movable member movable relative to said fixed body along the up-down direction and having a horizontal slide slot that permits said second arm of said biasing member to extend movably therethrough, so as to drive said first arm to pivot about said pivot pin such that said clutch seat is moved between the unlock position and the lock position; and a driving member disposed within said fixed body and connected to said movable member for driving movement of said movable member relative to said fixed body.

10. The clutch mechanism as claimed in claim 7, wherein said sleeve ring portion of said clutch seat is formed with an annular groove engaging said first arm of said biasing member.

11. The clutch mechanism as claimed in claim 7, further comprising a housing unit including a knob seat and an outer cover set that covers said rotatable seat, said clutch seat and said driving unit, and that includes a cover having an outer surface facing away from said clutch seat along the in-out direction and permitting said knob seat to be mounted thereon, said knob seat including a seat body and at least one limiting plate detachably mounted to said seat body, said accessible knob being rotatably mounted to said knob seat and having an outer surface that is formed with an annular groove engaging a portion of said limiting plate so as to retain said accessible knob in said knob seat.

12. The clutch mechanism as claimed in claim 7, further comprising a housing unit including an outer cover set that covers said rotatable seat, said clutch seat and said driving unit, and that includes an outer cover seat including a battery slot adapted to accommodate a battery therein for supplying power to said driving unit, and a battery lid detachably covering said battery slot.

13. An electronic lock comprising:

a lock device including a lock cylinder that includes a latch member extending along an axis that extends along an in-out direction and operable to lock and unlock said lock device; and a clutch mechanism mounted to said lock cylinder and including:

a clutch unit that includes:

a rotatable seat that is rotatably sleeved on the lock cylinder and that permits said latch member to extend therethrough, an accessible knob that is rotatably sleeved on said lock cylinder and engaging an end portion of said rotatable seat so as to drive said rotatable seat to rotate about the axis, and a clutch seat that detachably engages an opposite end portion of said rotatable seat and that is movable relative to said latch member along the in-out direction, said rotatable seat including a bush section that is sleeved on said lock cylinder, and a connecting section that extends from said bush section away from said clutch seat along the in-out direction and having a first engaging portion that is adjacent to said clutch seat, and a first coupling portion that is adjacent to said accessible knob, said accessible knob including an annular portion that is sleeved on said lock cylinder, and a second coupling portion that is non-rotatably coupled to said first coupling portion of said rotatable seat, said clutch seat including a sleeve ring portion that is sleeved on said bush section of said rotatable seat, and a second engaging portion that detachably engages said first engaging portion, said clutch seat being movable relative to said rotatable seat between an unlock position and a lock position, where said second engaging portion engages and disengages said first engaging portion, respectively;

a driving unit including a pivot pin, a biasing member and a driving device, said biasing member including a main body, through which said pivot pin extends, a first arm which extends from said main body along an up-down direction transverse to the in-out direction and which engages said clutch seat, and a second arm that extends from said main body along the in-out direction and which is connected to said driving device, said driving device being operable to drive said biasing member to move said clutch seat between the unlock position and the lock position; and a control module communicatively connected to said driving unit and configured to control operation of said driving unit to drive said biasing member to move said clutch seat between the unlock position and the lock position;

wherein said sleeve ring portion of said clutch seat is formed with a limiting slot configured to engage said latch member of said lock cylinder so as to drive said latch member to rotate and unlock said electronic lock.

14. The electronic lock as claimed in claim 13, wherein said bush section has an end formed with an annular flange extending radially and outwardly therefrom, and said connection section includes a connecting plate extending from a portion of said annular flange along the in-out direction toward said accessible knob, and two connecting blocks spaced apart from each other along a left-right direction transverse to the up-down direction and the in-out direction, extending from said connecting plate, and defining said first coupling portion.

15. The electronic lock as claimed in claim 13, wherein said driving device includes: a fixed body; a movable member movable relative to said fixed body along the up-down direction and having a horizontal slide slot that permits said second arm of said biasing member to extend movably therethrough so as to drive said first arm to pivot about said pivot pin such that said clutch seat is moved between the unlock position and the lock position; and a driving member disposed within said fixed body and connected to said movable member for driving movement of said movable member relative to said fixed body.

16. The electronic lock as claimed in claim 13, wherein said sleeve ring portion of said clutch seat is formed with an annular groove engaging said first arm of said biasing member.

17. The electronic lock as claimed in claim 13, wherein the clutch mechanism further includes a housing unit including a knob seat and an outer cover set that covers said rotatable seat, said clutch seat and said driving unit, and that includes a cover having an outer surface facing away from said clutch seat along the in-out direction and permitting said knob seat to be mounted thereon, said knob seat including a seat body and at least one limiting plate detachably mounted to said seat body, said accessible knob being rotatably mounted to said knob seat and having an outer surface that is formed with an annular groove engaging a portion of said limiting plate so as to retain said accessible knob in said knob seat.

18. The electronic lock as claimed in claim 13, wherein the clutch mechanism further includes a housing unit including an outer cover set that covers said rotatable seat, said clutch seat and said driving unit, and that includes an outer cover seat including a battery slot adapted to accommodate a battery therein for supplying power to said driving unit, and a battery lid detachably covering said battery slot.

19. An electronic lock comprising:

a lock device including a lock cylinder that includes a latch member extending along an axis that extends along an in-out direction and operable to lock and unlock said lock device; and a clutch mechanism mounted to said lock cylinder and including:

a clutch unit that includes:

a rotatable seat that is rotatably sleeved on the lock cylinder and that permits said latch member to extend therethrough, an accessible knob that is rotatably sleeved on said lock cylinder and engaging an end portion of said rotatable seat so as to drive said rotatable seat to rotate about the axis, and a clutch seat that detachably engages an opposite end portion of said rotatable seat and that is movable relative to said latch member along the in-out direction, said rotatable seat including a bush section that is sleeved on said lock cylinder, and a connecting section that extends from said bush section away from said clutch seat along the in-out direction and having a first engaging portion that is adjacent to said clutch seat, and a first coupling portion that is adjacent to said accessible knob, said accessible knob including an annular portion that is sleeved on said lock cylinder, and a second coupling portion that is non-rotatably coupled to said first coupling portion of said rotatable seat, said clutch seat including a sleeve ring portion that is sleeved on said bush section of said rotatable seat, and a second engaging portion that detachably engages said first engaging portion, said clutch seat being movable relative to said rotatable seat between an unlock position and a lock position, where said second engaging portion engages and disengages said first engaging portion, respectively;

a driving unit including a pivot pin, a biasing member and a driving device, said biasing member including a main body, through which said pivot pin extends, a first arm which extends from said main body along an up-down direction transverse to the in-out direction and which engages said clutch seat, and a second arm that extends from said main body along the in-out direction and which is connected to said driving device, said driving device being operable to drive said biasing member to move said clutch seat between the unlock position and the lock position; and a control module communicatively connected to said driving unit and configured to control operation of said driving unit to drive said biasing member to move said clutch seat between the unlock position and the lock position, wherein the clutch mechanism further includes a housing unit, said housing unit being configured for mounting of said driving unit and including a limiting member and an outer cover set that covers said rotatable seat, said clutch seat and said driving unit, and that includes a cover having an inner surface facing said clutch seat and permitting said limiting member to be mounted fixedly thereto, said limiting member including a blocking plate portion extending along the up-down direction and disposed between said connecting section of said rotatable seat and said sleeve ring portion of said clutch seat such that said clutch seat is spaced apart from said rotating seat, so as to prevent impact on said rotatable seat when said clutch seat moves toward said rotatable seat.

20. The electronic lock as claimed in claim 19, wherein said bush section has an end formed with an annular flange extending radially and outwardly therefrom, and said connection section includes a connecting plate extending from a portion of said annular flange along the in-out direction toward said accessible knob, and two connecting blocks spaced apart from each other along a left-right direction transverse to the up-down direction and the in-out direction, extending from said connecting plate, and defining said first coupling portion.

21. The electronic lock as claimed in claim 19, wherein said driving device includes: a fixed body; a movable member movable relative to said fixed body along the up-down direction and having a horizontal slide slot that permits said second arm of said biasing member to extend movably therethrough so as to drive said first arm to pivot about said pivot pin such that said clutch seat is moved between the unlock position and the lock position; and a driving member disposed within said fixed body and connected to said movable member for driving movement of said movable member relative to said fixed body.

22. The electronic lock as claimed in claim 19, wherein said sleeve ring portion of said clutch seat is formed with an annular groove engaging said first arm of said biasing member.

23. The electronic lock as claimed in claim 19, wherein the clutch mechanism further includes a housing unit including a knob seat and an outer cover set that covers said rotatable seat, said clutch seat and said driving unit, and that includes a cover having an outer surface facing away from said clutch seat along the in-out direction and permitting said knob seat to be mounted thereon, said knob seat including a seat body and at least one limiting plate detachably mounted to said seat body, said accessible knob being rotatably mounted to said knob seat and having an outer surface that is formed with an annular groove engaging a portion of said limiting plate so as to retain said accessible knob in said knob seat.

24. The electronic lock as claimed in claim 19, wherein the clutch mechanism further includes a housing unit including an outer cover set that covers said rotatable seat, said clutch seat and said driving unit, and that includes an outer cover seat including a battery slot adapted to accommodate a battery therein for supplying power to said driving unit, and a battery lid detachably covering said battery slot.

* * * * *